US007181811B1

(12) United States Patent
Tomanek et al.

(10) Patent No.: US 7,181,811 B1
(45) Date of Patent: Feb. 27, 2007

(54) MICRO-FASTENING SYSTEM AND METHOD OF MANUFACTURE

(75) Inventors: David Tomanek, East Lansing, MI (US); Richard Enbody, East Lansing, MI (US); Young-Kyun Kwon, Albany, CA (US)

(73) Assignee: Board of Trustees operating Michigan State University, East Lansing, MI (US)

( * ) Notice: Subject to any disclaimer, the term of this patent is extended or adjusted under 35 U.S.C. 154(b) by 0 days.

(21) Appl. No.: 09/601,540

(22) PCT Filed: Feb. 11, 1999

(86) PCT No.: PCT/US99/02897

§ 371 (c)(1),
(2), (4) Date: Sep. 6, 2000

(87) PCT Pub. No.: WO99/40812

PCT Pub. Date: Aug. 19, 1999

Related U.S. Application Data

(60) Provisional application No. 60/074,463, filed on Feb. 12, 1998.

(51) Int. Cl.
*A44B 18/00* (2006.01)

(52) U.S. Cl. ..... 24/442; 24/450; 24/452; 156/272.2; 156/297; 428/99; 428/100; 428/119; 428/120; 977/724; 977/882

(58) Field of Classification Search ..... 24/442, 24/444, 446–452; 423/447.1, 447.2; 428/420, 428/100, 402, 408, 99, 119, 120; 156/272.2, 156/274.4, 297; 977/DIG. 1, 724, 732, 882
See application file for complete search history.

(56) References Cited

U.S. PATENT DOCUMENTS

| | | | | |
|---|---|---|---|---|
| 3,879,835 | A | 4/1975 | Brumlik | |
| 3,889,322 | A | 6/1975 | Brumlik | |
| 3,921,258 | A | 11/1975 | Brumlik | |
| 4,531,733 | A | 7/1985 | Hall | |
| 5,179,499 | A | 1/1993 | MacDonald et al. | |
| 5,346,683 | A * | 9/1994 | Green et al. | 422/312 |
| 5,464,987 | A | 11/1995 | Ihara et al. | |
| 5,569,272 | A | 10/1996 | Reed et al. | |
| 5,657,516 | A | 8/1997 | Berg et al. | |
| 5,697,827 | A * | 12/1997 | Rabinowitz | 204/298.04 |
| 5,863,601 | A * | 1/1999 | Kikuchi et al. | |

(Continued)

OTHER PUBLICATIONS

"Single-Shell Carbon Nanotubes of 1-nm Diameter", Sumio Iijima & Toshinari Ichihashi, Letters to Nature, vol. 363—Jun. 17, 1993, pp. 603-605.

(Continued)

*Primary Examiner*—James R. Brittain
(74) *Attorney, Agent, or Firm*—Harness, Dickey & Pierce, P.L.C.

(57) ABSTRACT

This application relates to a micro-fastening system and, more particularly, to a mechanical micro-fastening system employing a plurality of mating nanoscale fastening elements (16, 18) and a method of manufacturing a micro-fastening system. The mating nanoscale fastening elements (16, 18) are formed by functionalizing nanotubes having an ordered array of hexagons with pentagons and heptagons at particular heterojunctions.

30 Claims, 2 Drawing Sheets

U.S. PATENT DOCUMENTS

| | | | | |
|---|---|---|---|---|
| 5,916,642 | A * | 6/1999 | Chang | 29/243.58 |
| 6,097,138 | A * | 8/2000 | Nakamoto | |
| 6,172,902 | B1 * | 1/2001 | Wegrowe et al. | 365/129 |
| 6,340,822 | B1 * | 1/2002 | Brown et al. | 257/25 |
| 2002/0085968 | A1 * | 7/2002 | Smalley et al. | |

OTHER PUBLICATIONS

Helical Microtubules of Graphitic Carbon, Sumio Iijima, Letters to Nature, vol. 354—Nov. 7, 1991, pp. 56-58.

"A Formation Mechanism for Catalytically Grown Helix-Shaped Graphite Nanotubes", S. Amelinckx, X. B. Zhang, D. Bernaerts, X. F. Zhang, V. Ivanov, J. B. Nagy, Science, New Series, vol. 265, Issue 5172 (Jul. 29, 1994), pp. 635-639, http://www.jstor.org/.

Nantubes for Electronics, Philip G. Collins and Phaedon Avouris, Scientific American, Dec. 2000, pp. 62-69.

"Fullerene Nanotubes: $C_{1,000,000}$ and Beyond", Boris I. Yakobson and Richard E. Smalley, American Scientist, vol. 85, Jul.-Aug. 1997, pp. 324-337.

"Carbon Nanotubes", Sumio Iijima, MRS Bulletin, vol. 19, No. 11, Nov. 1994, pp. 43-49, 1 drawing page.

Supplemental European Search Report for EP 99 90 8118, 2 pages, Jul. 23, 2003.

* cited by examiner

MICRO-FASTENING SYSTEM AND METHOD OF MANUFACTURE

CROSS REFERENCE TO RELATED APPLICATIONS

This application is a national stage entry of International Application PCT/US99/02897, filed Feb. 11, 1999, which claims the benefit of U.S. Provisional Application Ser. No. 60/074,463, filed Feb. 12, 1998.

This invention was made with Government support under contract US NAVY N00014-99-1-0252. The Government has certain rights in the invention.

BACKGROUND OF THE INVENTION

1. Field of the Invention

The present invention relates to a micro-fastening system and, more particularly, to a mechanical micro-fastening system employing a plurality of mating nanoscale fastening elements and a method of manufacturing the same.

2. Description of the Prior Art

Micro-fastening systems per se are utilized to connect distinct components brought into relative contact by strong bonds which span a gap at the interface and generally are less than one micrometer in size. In their most common embodiments, such microfastening systems have generally been in the form of chemical bonds such as adhesive bonds, welds and coatings. Numerous potential disadvantages associated with employing adhesives and coatings are known such as the irreversible nature of the bonds and the potential for degradation at relatively high temperatures. Further, adhesives and coatings generally require smooth dry interfaces which are free of impurities to effectuate high quality bonds. Welding results in a physical deformation of the surfaces being welded; it cannot be used effectively for interconnecting microscopically small components or large interface areas. Thus, there is a need for the mechanical "micro-fastening" system of the present invention.

SUMMARY OF THE INVENTION

The micro-fastening system of the present invention employs a plurality of mating nanoscale fastening elements which are obtained by structurally modifying, i.e., functionalizing nanotubes generally and carbon nanotubes particularly. Carbon nanotubes per se consist of a graphite monolayer having the overall shape of a cylinder including an ordered array of hexagonal carbon rings disposed along the cylindrical side walls which may be single or multi-walled as reported in *Nature*, Vol. 354 (1991) pp. 56–58 and ibid. Vol. 363 (1993) pp. 603–605. The ends of the tubes are often closed by pairs of pentagonal carbon rings. Carbon nanotubes generally range in diameter from one to about 50 nanometers, and may be as long as approximately 0.1 millimeters. While related to carbon fibers, nanotubes are free of atomic scale defects, which accounts for their high tensile strength, as compared to that of the strength of individual graphite layers. Like graphite, carbon nanotubes exhibit $sp^2$ bonding which gives rise to a relatively high degree of flexibility and resilience. Further, carbon nanotubes are structurally stable nearly up to the melting point of graphite, i.e., up to about 3,500 degrees Celsius.

By functionalizing the carbon nanotubes as will be described in greater detail below, the cylindrical shape can be modified to include bent portions. While it has been suggested generally that carbon nanotubes can be readily functionalized, it has yet to be reported that carbon nanotubes can be specifically functionalized so as to obtain mating fastening elements as herein described.

Among the various applications for the micro-fastening system of the present invention are the assembly of nanorobots useful for micro-surgical procedures, surface coatings, and attachment of metal contacts to integrated semiconductor devices, by way of non-limiting example.

The strength of micro-fastening systems described herein relies on the enormous stability of nanotubes, i.e., their large structural rigidity, the high strength of the bonds anchoring tubes in a substrate and a large number of connections possible on a limited surface area. In contrast to purely mechanical fasteners (such as bolts and screws) which weaken the surfaces to be connected, there is no apparent degradation of the opposing surfaces to be joined under the present invention. Adhesives are typically weaker than most mechanical fasteners and their strength is strongly diminished at higher temperatures. Welding is not practicable for large interfaces, whereas the fastening system of the present invention may be employed for both large and microscopically small interfaces. Bonding technologies excepting the micro-fastening system of the present invention leave macroscopically large gaps at the interface. Unlike known bonds between substrates, the micro-fastening system of the present invention has an effective thickness of the gap at interface as small as a few nanometers.

A further advantage of the present invention is that the surface bonds based on the nanotube based micro-fastening system, while extremely strong, may be re-opened and re-closed, i.e., they are reusable, whereas the surface bonds generated by gluing or welding are permanent. Thus, the micro-fastening system of the present invention is selectively reversible which is considered to be highly desirable, particularly for self-repair. This reusability or self-repairability is of particular advantage for interconnects exposed to changing forces or changing environmental variables (such as temperature) that result in a different expansion of the individual components brought into relative contact.

Still another advantage offered by the micro-fastening system of the present invention is that the conductivity of the fastening elements connecting the corresponding substrates may be varied from metallic to insulating, depending largely on the chemical composition, the diameter and chirality of the nanotubes.

BRIEF DESCRIPTION OF THE DRAWINGS

FIGS. 1(*d–f*) are a series of views demonstrating the representative opening mechanism and forces for a micro-fastening system in accordance with the teachings of the present invention.

DETAILED DESCRIPTION OF THE INVENTION

Figure 1A:
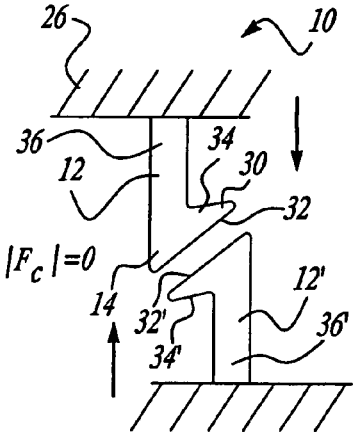
FIGS. 1(*a–c*) are a series of views demonstrating the representative closure mechanism and forces for a generic micro-fastening system in accordance with the teachings of the present invention.
Figure 1B:
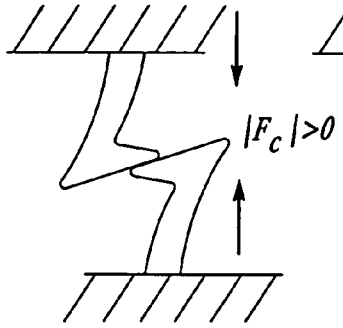
Figure 1C:
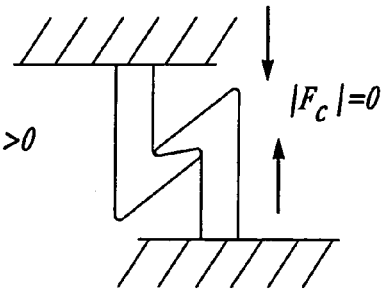
Figure 1D:
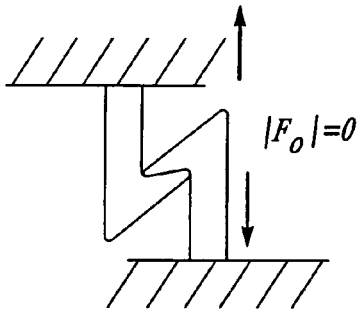
Figure 1E:
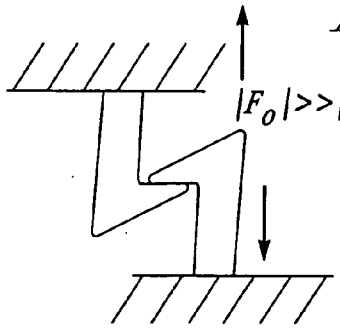
Figure 1F:
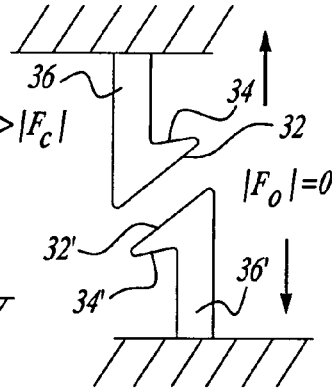

The micro-fastening system 10 of the present invention comprises a plurality of mating nanoscale fastening elements 12 and 12' manufactured by modifying, i.e., functionalizing nanotubes which are generally linear in nature prior to functionalizing. Upon functionalizing the nanotubes 14, fastening elements are obtained in a variety of non-linear forms such as hooks 16 and loops 18 as illustrated in FIGS. 3(*a–d*) and spirals 20 as illustrated in FIG. 4(*b*) by way of non-limiting example. The nanotubes employed may be composed of carbon, nitrogen, boron or other elements which give rise to layered honeycomb lattice structures. It is important from the outset to note that the nanotubes employed in accordance with the teachings of the present invention may be single walled, multi-walled or at least partially multi-walled over the length of the nanotube. For simplicity, the present invention will hereinafter generally be described in terms of functionalizing graphitic carbon nanotubes.

By "functionalizing" graphitic carbon nanotubes, it is meant that a specific number of pentagons and heptagons are substituted for hexagons within the nanotube or are added along the open edge(s) of the core nanotube which consists of an ordered array of hexagons.

Upon introducing pentagons and heptagons in a predetermined order, the carbon nanotubes will exhibit a locally positive or negative Gaussian curvature that results in a "bend" in the nanotube. By continuing to add pentagons and hexagons in a specific manner, the bend of the nanotube can be grown until the desired shape is obtained.

Upon growing the carbon nanotube to the desired length and shape, a first end 22 of the nanotube 14 may be capped or terminated, e.g., by introducing or forming a fullerene half dome along the end to be terminated. By providing a fullerene half-dome along an open end of the carbon nanotube, the end of the formed fastening element 12 becomes substantially inert, i.e., non-bonding to other atoms or molecules.

A second end 24 of the fastening element which is open, i.e., non-terminated, is bonded to a substrate 26 which may be in the form of various materials including metals, carbon (graphite or diamond), silicon, germanium, polymers and composites of the foregoing, to name a few. Other materials, provided they are capable of attaining a molten state, can also be employed.

Since the open end 24 of the nanotube is highly reactive and thus has a natural affinity for bonding to the desired substrate, the fastening element readily attaches to the substrate in a manner whereby the element stands up along the attachment surface. Nanotubes may be assisted in their alignment perpendicular to the surface by applying a strong electric field in that direction. This so-called affinity to migrate toward the surface is at least partially due to the low surface tension of the nanotube material. As will be understood by those skilled in the art, the tendency for the fastening elements to stand up promulgates mating between corresponding fastening elements.

Carbon nanotubes having ordered pairs of pentagons and heptagons may occur spontaneously to a limited extent during synthesis, thus forming hook shaped nanotubes as reported in MRS Bulletin, Vol. 19, No. 11, pp 43–49 (1994). However, in order to design carbon nanotubes such that they can be used effectively in micro-fastening systems, atomically dispersed catalysts may be necessary. For example, transition metals such as Fe and, more preferably, Ni, Co and Y have been shown to promote formation of single wall nanotubes or spiral structures as reported in Science 265, 635 (1994).

Curvature of the ends or other portions of relatively straight carbon nanotubes can be also accomplished by employing a template in proximity to a growing nanotube. In this regard, both on energetic and entropic grounds, a horizontally growing nanotube, when approaching a vertically positioned nanotube used as a template, has a higher probability to form ordered pairs of $C_5$ and $C_7$ carbon rings, i.e., pentagons and heptagons which would cause the former to "wrap around" the latter. As such, specifically functionalized carbon nanotubes 14 useful as fastening elements 12 such as those illustrated in FIGS. 4(*a–b*) can also be prepared without employing catalysts.

Figure 2:
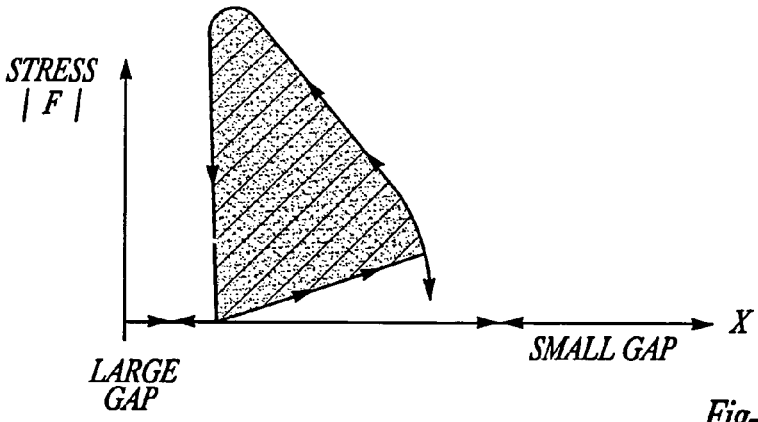
FIG. 2 is a schematic view illustrating a way to define the figure of merit of the micro-fastening system wherein the horizontal axis X represents the separation between the surfaces.
Figure 3A:
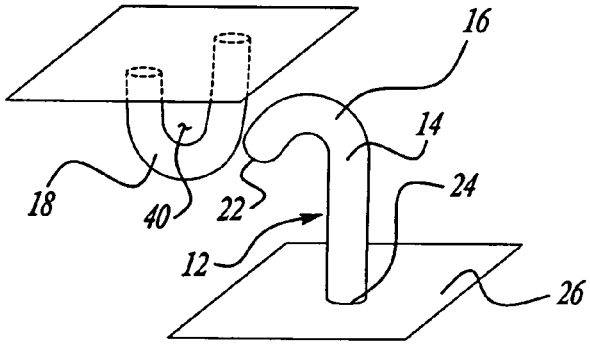
FIGS. 3(*a–d*) are a series of views demonstrating the representative opening and closure mechanisms and forces for a particular micro-fastening system based on nanotubes functionalized to form a mating hook and loop arrangement in accordance with the teachings of the present invention.
Figure 3B:
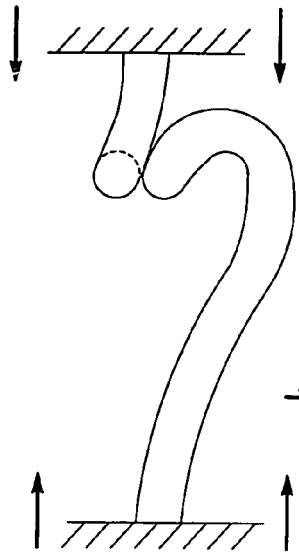
Figure 3C:
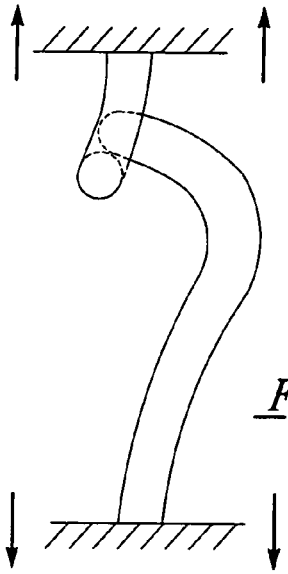
Figure 3D:
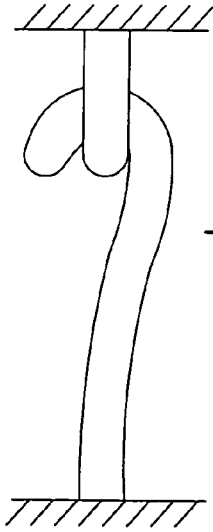

As shown in FIGS. 1(*a–c*), only a moderate force $F_c$ is required to selectively deform the nanotube and thereby accomplish an interconnection between the first and second fastening elements 12 and 12'. A much larger force $F_o$ is required to break the interconnection between the fastening elements 12 and 12' of components in contact as demonstrated in FIGS. 1(*d–f*). The hatched area in FIG. 2 represents the work required to close and re-open the gap and indicates the efficiency of a particular pair of mating nanoscale fastening elements.

As noted, while the fastening elements 12 and 12' can be formed into a number of different configurations, certain configurations are considered to be preferred. For a generic mechanical micro-fastening system, the opening and closing mechanism is shown in FIGS. 1(*a–f*). Generic fastening elements, shown in these figures, contain a substantially triangular shaped head 30. Under this schematic embodiment the angled surfaces 32 and 32' slide past the other as the fastening elements come into contact as they advance toward an interlocked position. This angular orientation of approximately 45° along surfaces 32 and 32' allows for a minimal amount of lateral deflection of the fastening elements during the attachment step. The attachment surfaces 34 and 34' preferably slope downwardly and away from their respective stems 36 and 36' to form an interconnection requiring a relatively high separation force, i.e., $|F_o|>>|F_c|$.

FIGS. 3(*a–d*) show one particular embodiment of the micro-fastening system, consisting of hook 16 and loop 18 fastening elements. Under this embodiment, as the hook and loop elements are advanced toward each other, the first end 22 of the hook deflects until there is sufficient clearance to insert into the aperture 40 of the loop element. As with the embodiment illustrated in FIGS. 1(*a–f*), the hook and loop fastening system requires a relatively high separation force $|F_o|>>|F_c|$ to detach the fastening elements as compared to the attachment forces.

Figure 4A:
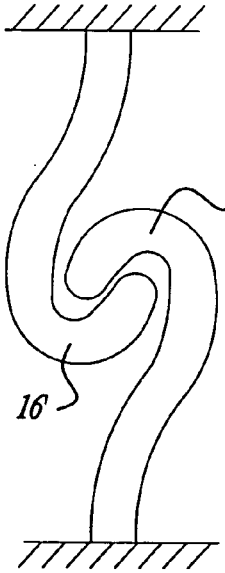
FIGS. 4(*a–b*) are illustrative of alternative mating nanoscale micro-fastening system elements in accordance with the teachings of the present invention.
Figure 4B:
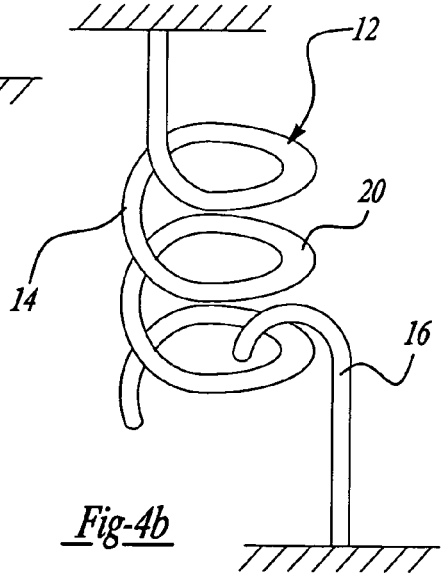

Still other embodiments such as hook 16 to hook 16' fastening as illustrated with reference to FIG. 4*a* and spiral 20 to hook 16 fastening as illustrated in FIG. 4*b* are considered as practical applications. In essence, the shape of the resulting fastening elements is a function of the processing parameters, as such various fastening element configurations are contemplated.

Additionally, it should be understood that micro-fastening elements having different shapes can be formed upon the same substrate. Thus, alternating rows of specifically shaped fastening elements along a useful substrate is an effective application. Of course, microfastening elements of differing configurations can be randomly applied to a substrate, if desired.

While it will be apparent that the preferred embodiments of the invention disclosed are well calculated to fulfill the objects stated, it will be appreciated that the invention is susceptible to modification, variation and change without departing from the spirit thereof.

The invention claimed is:

1. A microfastening system comprising:

a first fastening element including a plurality of extending nanotubes; and a second fastening element including a plurality of extending nanotubes;

wherein the fastening elements comprise a substrate including an attachment surface and a plurality of functionalized non-linear nanotubes, the non-linear nanotubes of the first and second fastening elements each having a first end and a second end, the non-linear nanotubes of the first and second fastening elements each being attached at the first end to and extending from said attachment surface, wherein the second end is free of the surface.

2. A microfastening system according to claim 1, wherein the substrate of the first and second fastening elements comprises material selected from the group consisting of metal, carbon, silicon, germanium, polymers, and composites thereof.

3. A microfastening system according to claim 1, wherein the nanotubes of the first and second fastening elements are at least partially multi-walled.

4. A microfastening system according to claim 1, wherein the non-linear nanotubes of the first and second fastening elements comprise hooks or spirals.

5. A microfastening system comprising:

a first fastening element including a plurality of extending nanotubes; and a second fastening element including a plurality of extending nanotubes, wherein said nanotubes of at least one of said fastening elements are selectively deformable;

whereby upon joining said first and second fastening elements, the extending nanotubes from each element become mechanically interconnected, wherein said fastening elements are reusable.

6. The microfastening system of claim 5 wherein at least one of said first and second fastening elements further comprises a substrate from which said nanotubes of the respective elements extend.

7. The microfastening system of claim 6 wherein said substrate is formed from materials selected from the group consisting of metals, carbon, silicon, germanium, polymers and composites thereof.

8. The microfastening system of claim 5 wherein said nanotubes of the first and second elements are at least partially multi-walled.

9. A method of manufacturing a microfastener comprising the steps of:

a) providing a substrate having an attachment surface;

b) introducing a plurality of open ended selectively deformable non-linear nanotubes to said substrate, each nanotube with a means for fastening, whereby said nanotubes are attracted to said attachment surface and become affixed thereto, wherein said microfastener is reusable.

10. The method of claim 9 wherein said nanotubes are functionalized prior to attaching to said substrate.

11. The method of claim 9 wherein said substrate is formed from materials selected from the group consisting of metals, carbon, silicon, germanium, polymers and composites thereof.

12. The method of claim 9 wherein said nanotubes are at least partially multi-walled.

13. The method of claim 9 wherein the non-linear nanotubes of said microfastener are selected from hooks, loops, spirals and combinations thereof.

14. The method of claim 9 wherein said nanotubes are attached to said substrate in the presence of an electric field.

15. A microfastening system comprising:

a first fastening element including a plurality of extending nanotubes; and a second fastening element including a plurality of extending nanotubes, at least some of which comprise nanotubes selected from the group consisting of a) hooks, and b) spirals, whereby upon joining said first and second fastening elements, the extending nanotubes from each element become mechanically interconnected.

16. The microfastening system of claim 15 wherein at least one of first and second fastening elements further comprises a substrate from which said nanotubes of the respective elements extend.

17. The microfastening system of claim 16 wherein said substrate is formed from materials selected from the group consisting of metals, carbon, silicon, germanium, polymers and composites thereof.

18. The microfastening system of claim 15 wherein said nanotubes of the first and second elements are at least partially multi-walled.

19. The microfastening system of claim 15 wherein said nanotubes of at least one of said fastening elements are selectively deformable.

20. The microfastening system of claim 15 wherein said fastening elements are reusable.

21. A method of manufacturing a microfastener having nanotubes with two ends, comprising the steps of:

a) providing a substrate having an attachment surface;

b) introducing a plurality of open ended nanotubes to said substrate, each nanotube with a means for fastening, whereby said nanotubes are attracted to said attachment surface and become affixed thereto, wherein at least some of the nanotubes become affixed at only one end, wherein said microfastener is reusable.

22. The method of claim 21 wherein said nanotubes are functionalized prior to attaching to said substrate.

23. The method of claim 21 wherein said substrate is formed from materials selected from the group consisting of metals, carbon, silicon, germanium, polymers and composites thereof.

24. The method of claim 21 wherein said nanotubes are at least partially multi-walled.

25. The method of claim 21 wherein the nanotubes are selected from the group consisting of loops, hooks, and spirals.

26. The method of claim 21 wherein at least some of said nanotubes are selectively deformable.

27. The method of claim 21 wherein said nanotubes are attached to said substrate in the presence of an electric field.

28. A microfastening system comprising a first fastening element comprising a plurality of extending nanotubes; and a second fastening element comprising a plurality of extending nanotubes, wherein extending nanotubes from each element are disposed so as to become mechanically interconnected as the first and second fastening elements are joined by advancing toward each other, and wherein extending nanotubes on both fastening elements are disposed so as to remain permanently fixed to their respective fastening elements during the action of advancing the elements toward each other, wherein the extending nanotubes comprise hooks or spirals.

29. A microfastening system according to claim 28, wherein the first and second fastening elements comprise a substrate from which the nanotubes of the respective elements extend, the substrate comprising a material selected from the group consisting of metal, carbon, silicon carbon, germanium, polymers, and composites thereof.

30. A microfastening system according to claim 28, wherein the nanotubes of the first and second fastening elements are at least partially multi-walled.

* * * * *